United States Patent [19]

Brown

[11] 4,173,967

[45] Nov. 13, 1979

[54] DRAFT AIR CONTROL FOR FIREPLACE GRATE

[76] Inventor: Rex M. Brown, 435 E., 1st N., Smithfield, Utah 84335

[21] Appl. No.: 790,449

[22] Filed: Apr. 25, 1977

[51] Int. Cl.[2] ..... F24B 13/02

[52] U.S. Cl. ..... 126/143; 126/165; 126/163 R

[58] Field of Search ..... 126/165, 164, 163 A, 126/163 R, 160, 153, 154, 152 B, 143

[56] References Cited

U.S. PATENT DOCUMENTS

| | | | |
|---|---|---|---|
| 131,994 | 10/1872 | Bradford | 126/143 |
| 2,346,586 | 4/1944 | Keown | 126/163 A |
| 2,375,318 | 5/1945 | Mudgett | 126/143 |
| 2,470,430 | 5/1949 | Carter | 126/143 |
| 4,050,441 | 9/1977 | Horwinski | 126/165 |

FOREIGN PATENT DOCUMENTS

| | | | |
|---|---|---|---|
| 15232 | of 1908 | United Kingdom | 126/164 |
| 317164 | 8/1929 | United Kingdom | 126/164 |
| 475707 | 11/1937 | United Kingdom | 126/164 |
| 512363 | 9/1939 | United Kingdom | 126/143 |
| 576552 | 4/1946 | United Kingdom | 126/164 |

*Primary Examiner*—Carlton R. Croyle
*Assistant Examiner*—Thomas I. Ross
*Attorney, Agent, or Firm*—Edward E. McCullough

[57] ABSTRACT

A tray has an upturned flange at least on the front edge thereof, and support means to space the tray above the floor of a fireplace, such that an opening is provided under the front of the tray to permit air flow. A hollow, raised portion in the tray, or draft control, has orifices that permit a controlled flow of air to fuel in the tray. The tray is closely fitted to the walls of a fireplace; so that, substantially, the only source of oxygen for the fuel in the grate is through the orifices in the draft control. In a preferred embodiment, the draft control is removable and fits over an opening in the tray. Also, valve means may be included for closing the draft control to any desired extent.

10 Claims, 4 Drawing Figures

FIG. 1
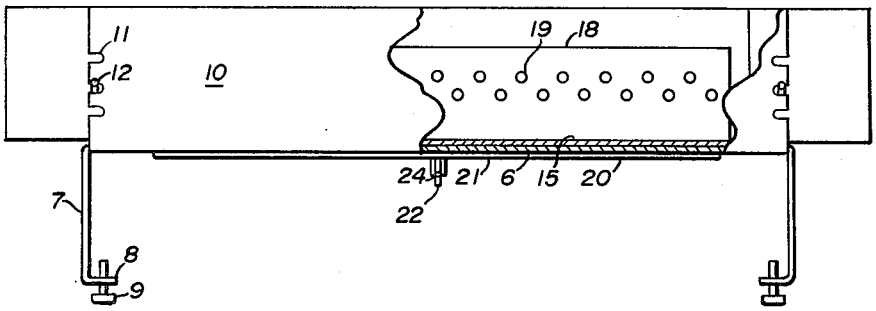
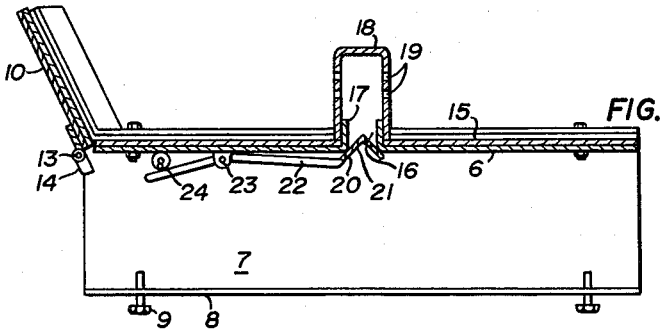
FIG. 2
FIG. 3
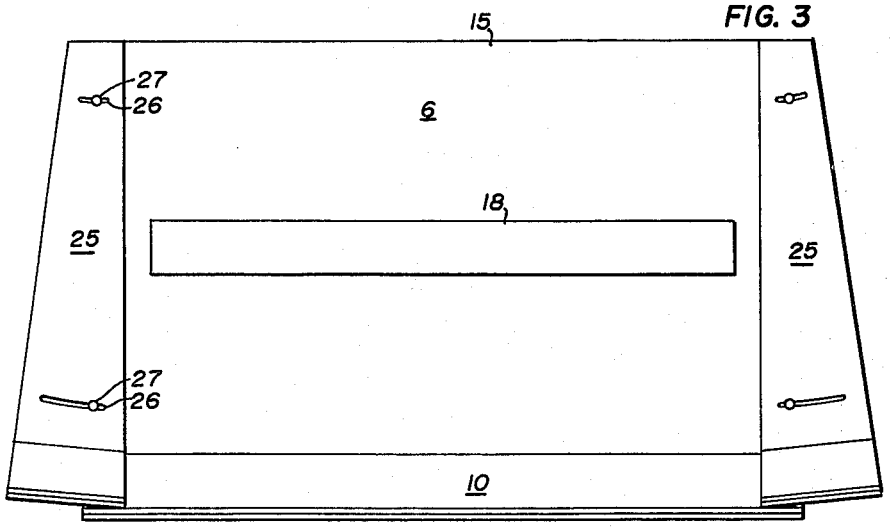
FIG. 4
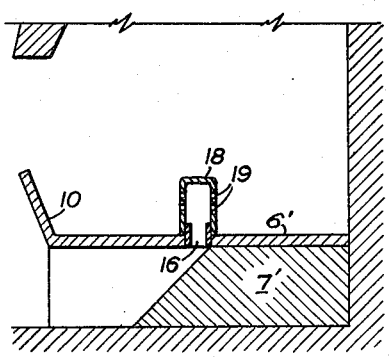

DRAFT AIR CONTROL FOR FIREPLACE GRATE

BACKGROUND OF THE INVENTION

This invention relates broadly to grates for holding fuel to be burned. Particularly, it relates to fireplace grates having solid trays with special orifices to supply oxygen to fuel.

The typical, conventional, fireplace grate is made of a plurality of parallel metal bars held together by cross bars welded thereto, and spaced above the fireplace floor by supports. Such grates offer no particular advantage in igniting the fuel; the fuel tends to burn rapidly, once ignited; and they are wasteful of fuel. Typical ashes found below such grates when the fire is extinguished contain a large percentage of incompletely burned fuel in the form of small pieces that have fallen through the grate and have become extinguished because of insufficient oxygen.

SUMMARY OF THE INVENTION

The present invention, which overcomes these difficulties of the prior art, is essentially a refractory tray having support means that spaces it from the floor of a fireplace in such a way that a frontal opening is provided under the tray. The tray has an upturned, frontal flange and is closely fitted to the walls of the fireplace, so that the air space within the tray is essentially separated from that below the tray. Hence, when fuel is ignited within the tray, a region of low atmospheric pressure is created therein, relative to the high pressure region beneath the tray. Air from this high pressure region is dispensed to the fuel only through orifices in the draft control, which is a hollow, raised portion of the tray, typically located in the central portion thereof. The draft control is preferably removable from the tray, and may be equipped with valve means for closing off the supply of oxygen passing therethrough to any extent desired.

A number of advantages are provided by the present invention that have not been available in prior-art grates:

1. The outer regions of the tray are low-pressure, oxygen-deficient regions, while the central portion thereof, adjacent the draft control is a high-pressure region with a controlled, constant supply of oxygen. Hence, fuel adjacent the draft control burns with a high temperature that consumes the fuel completely, while the fuel in the outer regions of the tray does not become ignited until it is moved toward the central portion thereof. Because of the high-temperature combustion in the central portion of the tray, very little of the fuel escapes in the form of smoke and very little of it is deposited as carbon on the walls of the fireplace. Also, since the grate is a solid tray, small pieces of unburned fuel cannot fall therethrough, and be wasted, as in prior-art grates. These features combine to save a considerable amount of fuel for the heat derived, relative to conventional grates.

2. Because of the concentrated supply of oxygen that begins to emerge through the draft control as soon as any heat is provided in the tray, fuel is ignited much more easily than it is in conventional grates.

3. Because of the thorough extent of fuel combustion, very little ash results, so that the fireplace requires infrequent cleaning. Also, since the draft control is removable, leaving only the flat surfaces of the tray to be cleaned, cleaning is easily accomplished.

4. The intense, central combustion of fuel, together with the reflective surfaces of the solid tray and walls and/or flanges surrounding it make the present invention especially amenable for use with cooking pots or for heating fireplace furnaces of the type that have heating tubes extending above the fire.

5. The total orifice area in the draft control is calculated to transmit a constant amount of oxygen to the fuel at a predetermined velocity. Hence, any sudden change in pressure within the chimney flue, such as that brought about by a gust of wind, cannot appreciably alter the rate of fuel combustion.

6. Since fuel is consumed in only a portion of the grate, a grate full of fuel is consumed more slowly than if a conventional grate were used.

7. The valve means on the draft control affords more positive, precise, and convenient control of the rate of combustion than is achieved by the conventional method of valving the chimney flue only.

8. The frontal flange of the tray is angled outwardly, so that it functions not only as a wall to confine the low-pressure region within the tray, but also as an air scoop, or venturi, to help compress the cool air entering the region beneath the tray from the room.

9. The orifices of the draft control are essentially self cleaning, since they are horizontally positioned, so that they cannot be clogged with ash, and because of the forced air passing through them. Conventional grates are highly variable in the quantity of oxygen they transmit to the fuel, because of their tendency to become obstructed with ashes or with the fuel, itself.

Objects of the invention are to provide a fireplace grate that saves fuel by burning it more efficiently; that is convenient to use for cooking and for heating a fireplace furnace; that is easy to clean; and that provides means for controlling the rate of fuel combustion with considerable precision.

Important features of the invention are that it is of simple and reliable construction. Other objects and advantages of the invention will become apparent as the following detailed description is read with reference to the accompanying drawings. The same numbers refer to the same parts throughout the disclosure.

BRIEF DESCRIPTION OF THE DRAWINGS

In the drawings:

FIG. 1 is a front elevation of the invention, with some parts broken away to show the draft control;

FIG. 2 is a side elevation in section;

FIG. 3 is a top view of the invention; and

FIG. 4 is a front elevation of a second embodiment of the invention, showing how it can built into a fireplace.

DESCRIPTION OF THE PREFERRED EMBODIMENTS

The embodiment of the invention shown in FIGS. 1–3 has a flat tray 6, preferably made of sheet steel, which is supported and spaced from the floor of a fireplace by a downwardly-extending flange 7 from each lateral side of the tray 6. The support flanges 7 are preferably formed from the same sheet of steel as the tray by bending. If desired, each support flange may have a small, horizontal flange 8 having adjustment screws 9 for raising or lowering the tray 6. An upturned, frontal flange 10 is preferably angled outwardly at about 40° to the vertical. In a preferred embodiment (FIG. 1), the flange 10 is detachable from the tray 6, and is vertically adjustable relative thereto by a series of slots 11 in the ends of the flange 10 that are selectively engageable to pegs 12 fixed to the tray 6. Alternatively the frontal flange 10 may be hinged at 13 to the tray 6, and may be equipped with a stop 14, so that it may be used to support cooking pots, etc. (See FIG. 2).

The tray 6 and its flange 8 are lined with a layer 15 of fire brick or other material that is refractory at fire place temperatures.

The tray 6 and its fire brick lining 15 have a central, rectangular opening 16 having two parallel, upturned flanges 17 over which the draft control, in a preferred embodiment, is fitted. The draft control 18 is an elongated enclosure, open at the bottom, and having orifices 19 in the sides thereof. The orifices 19 are horizontally oriented, so that they cannot become plugged with ash; they are carefully located, so that they are always above the normal layer of ash in the tray 6, yet, not too high to provide oxygen to the fuel; and their size and number are carefully calculated to transmit the desired quantity of air flow per second and at the desired velocity, under normal operating conditions. A preferred material for the draft control 18 is cast iron, since it exhibits a minimal amount of corrosion under the normal operating conditions of a typical fireplace. Although the draft control 18 is preferably removable from the tray 6, since this greatly facilitates cleaning of the tray, it could be simply a raised portion of the tray and could also be insulated with refractory material.

Control of the air flow through the draft control 18 may be enhanced, with considerable precision, by an optional valve means 20, capable of closing the draft control 18 to any desired extent. This may be accomplished by any of a number of means, such as by a simple gate valve comprising a flat plate that may slide over the under side of the opening 16 in the tray 6. However, in the preferred embodiment shown in the Figures, it comprises an angle bar 21, having the same length as the opening 16 and positioned so that its vertex is uppermost and the flanges extend downwardly at equal angles to the vertical. The span across the edges of the flanges is preferably greater than the width of the opening 16, so that the opening can be completely closed by the angle bar 21. A lever 22, pivoted to the under side of the tray 6 at 23, extends from the front of the tray 6 at one end and is attached to the angle bar 21 at its other end. This lever 22 is used to move the angle bar relative to the opening 16 in the tray 6 for closing the opening to the extent desired. Considerable precision in valving the draft control 18 by this means may be obtained by adding the small cam 24, eccentrically pivoted to the tray 6 so that it may be operated against the lever 22.

Since this embodiment of the invention depends on the walls of a fireplace to help seal off the region above the tray 6 from that below the tray, lateral, adjustable extensions 25 of the tray 6 are provided. Slotted holes 26 therein are equipped with screws 27, so that the tray 6 may be made to fit virtually any fireplace. An unexpected result of experimentation was that the normally-produced ashes function very satisfactorily to seal cracks and openings between the tray 6 and walls of a fireplace.

FIG. 5 illustrates how the invention may be built into a fireplace as a permanent, integral part thereof. The tray 6' may be made, as a shelf-like structure, of any refractory material, such as fire brick, supported by masonry 7'. All other parts are identical to those described above, and function in the same way.

As soon as fuel is ignited, the heat of ignition creates a low-pressure region above the tray 6, relative to the high pressure region below the tray. Air from the room then rushes to replenish the region below the tray as it is drawn through the orifices 19 of the draft control 18. The incoming air from the room is compressed and accelerated somewhat by the venturi effect of the angled, frontal flange 10, which also serves to prevent the incoming air from entering the lower-pressure region within the tray directly.

The controlled flow of air through the orifices facilitates ignition of the fuel adjacent thereto, and tends to burn it intensely, while the fuel in the outer areas of the tray 6 does not become ignited, until it is moved near the draft control 18. Once ignited, the fuel may be made to burn as slowly as desired by means of the valve 20.

It has been found that the present invention consumes fuel completely with very little resulting ash, and that its flat, reflective surfaces are a distinct asset in cooking, and when the fireplace is used with a furnace of the type in which heating tubes extend over the fire.

An invention has been described that provides advances in the art of fireplace grates. Although the preferred embodiments have been described specifically with regard to detail, it should be noted that many details may be altered without departing from the scope of the invention, as it is defined in the following claims.

The invention claimed is:

1. A fireplace grate comprising:

a flat, refractory tray, the rear and side edges of which are capable of sealed relationship with the walls of a fireplace;

support means for spacing the tray above the floor of a fireplace to provide an air space beneath the tray that is open at the front for free flow of draft air from a room;

a draft control comprising a hollow enclosure, open at the bottom thereof and having horizontal orifices in its sides; and means for mounting the draft control over an opening in the central portion of the tray, the open bottom of the draft control being coextensive, substantially, with the opening, so that draft air from the space beneath the tray can enter the space above it through the orifices, which are the only openings in the tray, whereby the flow of draft air can be concentrated on fuel surrounding the draft control.

2. The grate of claim 1 wherein the draft control is elongated, located in the central portion of the tray, and oriented to be parallel to the front edge thereof.

3. The grate of claim 1 wherein the draft control is made of cast iron.

4. The grate of claim 1 further including valve means for closing and opening under the draft control to any desired extent.

5. The grate of claim 1 wherein the tray is made of steel lined with refractory material.

6. The grate of claim 1 wherein the refractory material is fire brick.

7. The grate of claim 1 wherein the tray has an upturned flange only on the front edge thereof; and further including an adjustable extension of the tray and the frontal flange on each of the two lateral sides thereof, so that the tray can be made to fit the walls of a fireplace in substantially sealed relationship therewith.

8. The grate of claim 1 wherein the support means comprises a downwardly extending flange from each of the two lateral sides of the tray.

9. The grate of claim 1 wherein the frontal flange is hinged to the tray and further including stop means, so that the flange may be horizontally positioned.

10. A flat, refractory tray having rear and side edges that fit the walls of a fireplace, to promote sealed relationship therewith;

support means for spacing the tray above the floor of a fireplace, such that an opening is provided below the front edge of the tray to permit free flow of air therunder;

a draft control having the form of an elongated, raised portion of the tray, having horizontal orifices in the sides thereof, which are the only openings in the tray that permit air from the region beneath the tray to pass to the region above it; and valve means for closing the opening under the draft control to any desired extent, comprising: an angle bar positioned so that the flanges extend downwardly from the vertex; a lever, pivotally attached to the tray, extending at one end to the front of the tray and attached at its other end to the angle bar, so that the angle bar may be moved into and out of the opening below the draft control to close it to the desired extent.

* * * * *